US008840105B1

(12) United States Patent
Priebe

(10) Patent No.: US 8,840,105 B1
(45) Date of Patent: Sep. 23, 2014

(54) RECHARGER TO RESTORE ELECTROSTATIC HOLDING FORCE

(71) Applicant: Alan Richard Priebe, Rochester, NY (US)

(72) Inventor: Alan Richard Priebe, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/956,652

(22) Filed: Aug. 1, 2013

(51) Int. Cl.

| | |
|---|---|
| ***B41J 2/01*** | (2006.01) |
| ***B65H 29/30*** | (2006.01) |
| ***B41J 11/00*** | (2006.01) |
| ***B65H 5/00*** | (2006.01) |

(52) U.S. Cl.
CPC ..... *B41J 11/002* (2013.01); *B65H 5/004* (2013.01); *B65H 29/30* (2013.01)
USPC ..... 271/193; 271/275; 271/18.1; 347/102; 347/104

(58) Field of Classification Search
CPC ..... B41J 11/002; B65H 29/30; B65H 5/004
USPC ..... 271/193, 275, 18.1; 347/102, 104
See application file for complete search history.

(56) References Cited

U.S. PATENT DOCUMENTS

| | | | | |
|---|---|---|---|---|
| 5,918,875 | A | 7/1999 | Masley et al. | |
| 7,651,212 | B2 * | 1/2010 | Kadomatsu et al. | 347/102 |
| 8,408,539 | B2 | 4/2013 | Moore | |
| 2002/0092735 | A1 * | 7/2002 | Greive et al. | 198/835 |
| 2011/0109037 | A1 | 5/2011 | Kunioka | |

OTHER PUBLICATIONS

Barthakur et al., "Evaporation rate enhancement of water with air ions from a corona discharge," International Journal of Biometeorology, vol. 31, pp. 29-33 (1995).

* cited by examiner

*Primary Examiner* — Luis A Gonzalez
(74) *Attorney, Agent, or Firm* — Kevin E. Spaulding

(57) ABSTRACT

A printer includes a transport belt having an electrically non-conducting surface adapted to transport a receiver medium along a transport path from an upstream position to a downstream position. A charging subsystem is configured to add charge to the transport belt or the receiver medium, thereby providing an electrostatic holding force. An inking subsystem is positioned downstream of the charging subsystem and deposits a pattern of ink on the receiver medium. A dryer positioned downstream of the inking subsystem is adapted to dry the inked receiver medium. A recharging subsystem positioned downstream of the dryer is configured to restore at least some charge dissipated while the receiver medium is transported between the charging subsystem and the recharging subsystem.

20 Claims, 6 Drawing Sheets

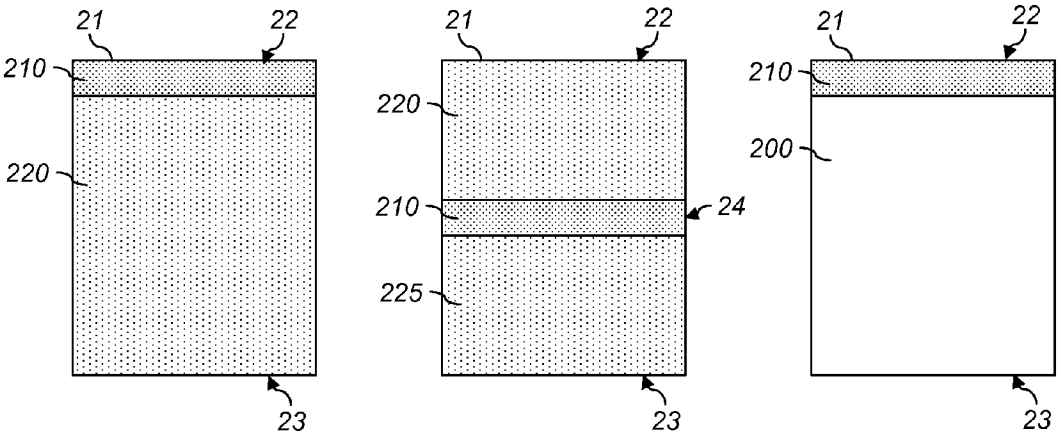
FIG. 5A
FIG. 5B
FIG. 5C
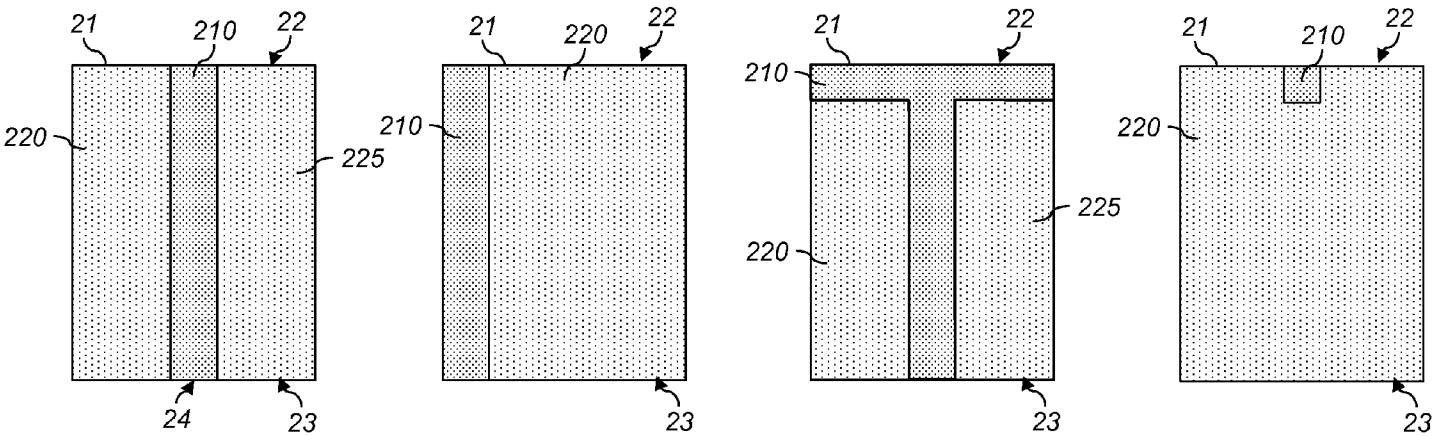
FIG. 5D
FIG. 5E
FIG. 5F
FIG. 5G

RECHARGER TO RESTORE ELECTROSTATIC HOLDING FORCE

CROSS-REFERENCE TO RELATED APPLICATIONS

Reference is made to commonly assigned, co-pending U.S. patent application Ser. No. 13/956,668, entitled "Charger providing non-uniform electrostatic holding force" by Priebe; and to commonly assigned, co-pending U.S. patent application Ser. No. 13/956,692, entitled "Controlling recharging to restore electrostatic holding force" by Priebe, each of which is incorporated herein by reference.

FIELD OF THE INVENTION

This invention pertains to the field of printing and more particularly to retaining receiver media on a transport belt using an electrostatic holding force during printing.

BACKGROUND OF THE INVENTION

In a digitally controlled printing system, for example an inkjet printing system, a receiver medium is directed through a series of components. The receiver medium can be a cut sheet or a continuous web. A transport system physically moves the receiver medium through the printing system. As the receiver medium moves through an inkjet printing system, liquid, (e.g., ink), is applied to the receiver medium by one or more printheads through a process commonly referred to a jetting of the liquid. The jetting of liquid onto the receiver medium introduces significant moisture content to the receiver medium, particularly when the system is used to print multiple colors on a receiver medium. Due to its moisture content, the receiver medium can undergo various physical changes, which can include change in electrical resistivity as well as changes in physical dimension and mechanical stiffness.

Cut sheet transport systems typically employ a holding force to hold the receiver medium to a transport mechanism, such as a belt or a drum. The holding force on the receiver medium can be applied using vacuum or electrostatic force, for example. Transport systems using electrostatic force can be advantageous because of their simplicity, and are frequently used in printing systems using dry printing processes, such as electrophotography. For example, U.S. Pat. No. 5,918,875 to Masley et al., entitled "Zero clearance handle," describes a paper feeding system in which a copy sheet is charged so that the sheet is electrostatically secured (or "tacked") to a photoreceptor belt. The sheet is then provided with an opposite charge so that it can be removed (or "detacked") from the transport belt.

For printing systems where a liquid ink is applied to the receiver medium, the resulting change in electrical resistivity of the receiver medium can adversely impact the reliability of using electrostatic holding for the receiver medium. Moist paper can dissipate charge relatively quickly. Moreover, connected regions of liquid permit charge to move through them, potentially redistributing charge on the receiver medium. Evaporation of components of liquid ink can also result in ionization that neutralizes some of the charge on the receiver medium. Still, some inkjet systems can be compatible with electrostatic holding of the receiver medium. U.S. Patent Application Publication No. 2011/0109037 to Kunioka entitled "Sheet feeder and image forming apparatus incorporating same," describes an ink-ejecting printer having recording heads mounted on a carriage over a transport belt. The transport belt electrostatically holds a receiver sheet and transports it to a position facing the recording heads. In a carriage printer, the printheads are moved by the carriage to print a swath of an image and advance the print medium between swaths in order to form the image swath by swath. In this application, the transport belt is able to provide sufficient electrostatic holding force for the portion of the cut sheet receiver medium that has not yet been printed. After the entire image is printed, the sheet is transported only a short way to an output tray.

High volume cut sheet printing systems typically print one color of an entire line of the image essentially all at once, for example using a page-width printhead or other page-width printing processes in a printing station for that color. The cut sheet is advanced past the printing station as page-width lines of the same color are printed sequentially. To print all colors (typically requiring at least cyan, magenta, yellow and black), the receiver medium is moved past a sequence of printing stations, one for each color. Dryers are typically provided between printing stations for evaporating volatile components of ink from the receiver medium, thereby increasing ionization due to evaporation. This can weaken the electrostatic holding force such that holding of the receiver medium is no longer reliable. If the receiver medium is no longer tightly held to the belt, registration of the colors printed by successive printing stations can be lost, thereby degrading print quality. Loosened receiver medium can also cause paper jams.

There remains a need for an electrostatic holding system that provides a reliable electrostatic holding force for the transport of sheets of receiver media through a cut sheet printing system. In addition, what is needed is an electrostatic holding system that accommodates dimensional changes in receiver medium that has absorbed liquid during the printing process.

SUMMARY OF THE INVENTION

The present invention represents a printer comprising:

a transport belt having an electrically non-conducting surface adapted to transport a receiver medium along a transport path from an upstream position to a downstream position;

a charging subsystem configured to add charge to the transport belt or the receiver medium, thereby providing an electrostatic holding force between the transport belt and the receiver medium;

an inking subsystem positioned downstream of the charging subsystem that deposits a pattern of ink on the receiver medium;

a dryer positioned downstream of the inking subsystem adapted to dry the inked receiver medium; and a recharging subsystem positioned downstream of the dryer configured to restore at least some charge dissipated while the receiver medium is transported between the charging subsystem and the recharging subsystem.

This invention has the advantage that the recharging subsystem restores charge dissipated during the printing process so that the receiver medium can be reliably transported along a downstream portion of a transport path.

It has the additional advantage that it enables electrostatic receiver medium holding systems to be used in inkjet printers where charge dissipates during the printing process.

BRIEF DESCRIPTION OF THE DRAWINGS

FIGS. 5A-5G show examples of position-dependent non-uniform charge on sheets of receiver medium.

The attached drawings are for purposes of illustration and are not necessarily to scale. Identical reference numerals have been used, where possible, to designate identical features that are common to the figures.

DETAILED DESCRIPTION OF THE INVENTION

Figure 1A:
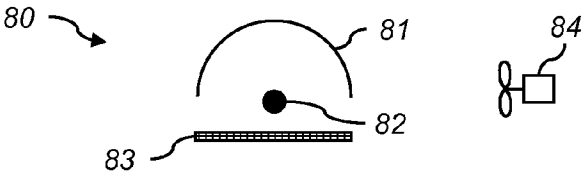
FIG. 1A is a corona unit that can be used to provide an electrostatic charge.

The present description will be directed in particular to elements forming part of, or cooperating more directly with, apparatus in accordance with the present invention. It is to be understood that elements not specifically shown or described may take various forms well known to those skilled in the art.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Ink printing processes can be embodied in single-function printers or in multi-function devices that also provide functions such as copying, scanning and facsimile transmission or reception. Ink printers operate by depositing marking material on a receiver medium (e.g., paper). Inkjet printing is a non-contact application of an ink to a receiver medium. Typically, one of two types of ink jetting mechanisms is used: drop-on-demand inkjet printing or continuous inkjet printing.

The first inkjet printing technology, drop-on-demand inkjet printing, provides ink drops that impact upon a recording surface using a pressurization actuator, for example, a thermal, piezoelectric, or electrostatic actuator. One commonly practiced drop-on-demand inkjet printing type uses thermal energy to eject ink drops from a nozzle. A heater, located at or near the nozzle, heats the ink sufficiently to form a vapor bubble that creates enough internal pressure to eject an ink drop. This form of inkjet is commonly termed thermal inkjet. A second commonly practiced drop-on-demand inkjet printing type uses piezoelectric actuators to change the volume of an ink chamber to eject an ink drop.

The second inkjet printing technology, commonly referred to as continuous inkjet printing, uses a pressurized ink source to produce a continuous stream of liquid ink by forcing ink, under pressure, through a nozzle. The stream of ink is perturbed using a drop forming mechanism such that the liquid jet breaks up into drops of ink in a predictable manner. One continuous inkjet printing type uses thermal stimulation of the liquid jet with a heater to form drops that eventually become print drops and non-print drops. Printing occurs by selectively deflecting either the print drops or the non-print drops and catching the non-print drops. Various approaches for selectively deflecting drops have been developed including electrostatic deflection, air deflection, and thermal deflection.

The invention described herein is applicable to both drop-on-demand and continuous inkjet printing technologies. As such, the term inkjet printhead, as used herein, is intended to be generic and not specific to either technology. The invention can also be applied to other types of printers such as electrophotographic printers.

Inkjet inks typically include colorants (e.g., cyan, magenta, yellow or black pigments or dyes) and a carrier fluid (e.g., water or alcohol), together with other components such as biocides, humectants and surfactants for reliable jetting and for proper interaction with the receiver medium. The carrier fluid helps to convey the colorant to the receiver medium, but once the ink drops hit the receiver medium, the carrier fluid needs to be managed through absorption into the receiver medium or evaporation from the receiver medium. If too much carrier fluid from one color of ink remains at the surface of the receiver medium when another color of ink is deposited in the same location, the wet inks can bleed into each other, thereby degrading print quality. If too much carrier fluid is absorbed into the receiver medium, the receiver medium can become limp or change shape, making it more difficult to transport through the printing system. Mid-volume to high-volume inkjet printing systems, which can print more than 100 pages per minute, typically include dryers between successive printing stations that print the different colors of ink.

A printer typically includes a digital front-end processor, a marking engine (also referred to in the art as a "print engine") for applying marking material to the receiver medium, and optionally one or more post-printing finishing systems (e.g., a UV coating system, a glosser, or a laminator). The digital front end processor converts input electronic files into image bitmaps for the marking engine to print, and permits operator control of the output. The marking engine takes the image bitmap and renders the bitmap into a form that can control the printing process. The finishing system applies features such as protection, glossing, or binding to the prints. A transport unit moves the receiver medium through the printer.

Transport systems of the present invention include transport belts 10 (FIG. 1B) that use electrostatic holding force to hold the receiver medium. FIG. 1A shows a schematic diagram of a corona charging unit 80 that can be used to charge at least one of the transport belt 10 and the receiver medium in order to provide the electrostatic holding force. Corona charging unit 80 includes a wire 82 partially surrounded by a body 81, and a conductive grid 83 positioned near an open end of the body 81 between the wire 82 and a region that is desired to be charged. Wire 82 is connected to a high voltage supply (not shown) that provides a voltage, typically at several kilovolts (e.g., 3 kV). Conductive grid 83 is connected to a voltage supply (not shown), typically at several hundred volts (e.g., around 500V). The grid voltage is typically adjustable. The air around wire 82 is ionized by corona discharge. Flow of ions from corona charging unit 80 can be controlled by adjusting the grid voltage. Optionally, the corona charging unit 80 can be air purged after corona discharge events using a blower 84 in order to prevent the accumulation of contaminants such as ozone, various oxides of nitrogen, or acidified droplets of water that can result from the ionization process during corona discharge in air.

Figure 1B:
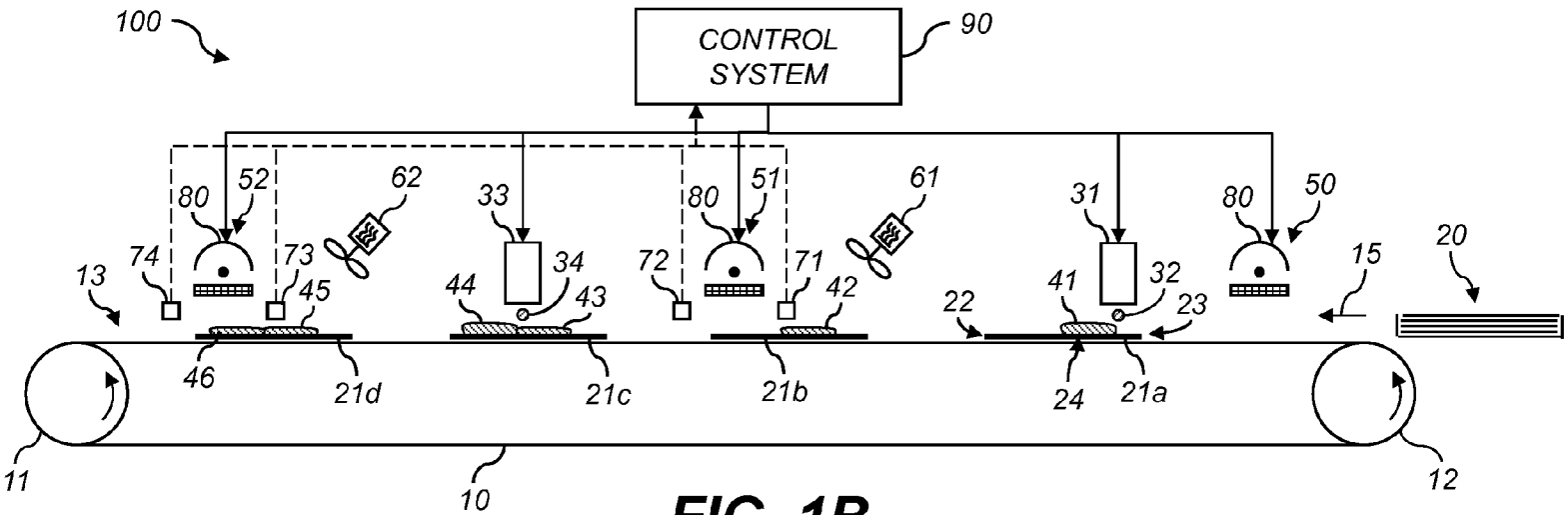
FIG. 1B is a side view of a printing system having corona charging and recharging subsystems according to an embodiment of the invention.

FIG. 1B shows a side view of a portion of a printer 100 having a transport belt 10 that winds around roller 11 and roller 12. Because transport belt 10 continuously moves around roller 11 and roller 12, it can be said that transport belt 10 is "rotatable." An upper belt portion 13 of transport belt 10 moves receiver medium sheets 21*a*, 21*b*, 21*c*, 21*d* from an input receiver medium stack 20 along a transport path 15 in a direction from upstream to downstream past the various components of printer 100. The transport belt 10 includes an outer surface that is in contact with the receiver medium sheets 21*a*, 21*b*, 21*c*, 21*d* and an inner surface that is in contact with rollers 11 and 12. The outer surface of transport belt 10 is electrically non-conducting in order to impede the dissipation of charge.

Figure 2:
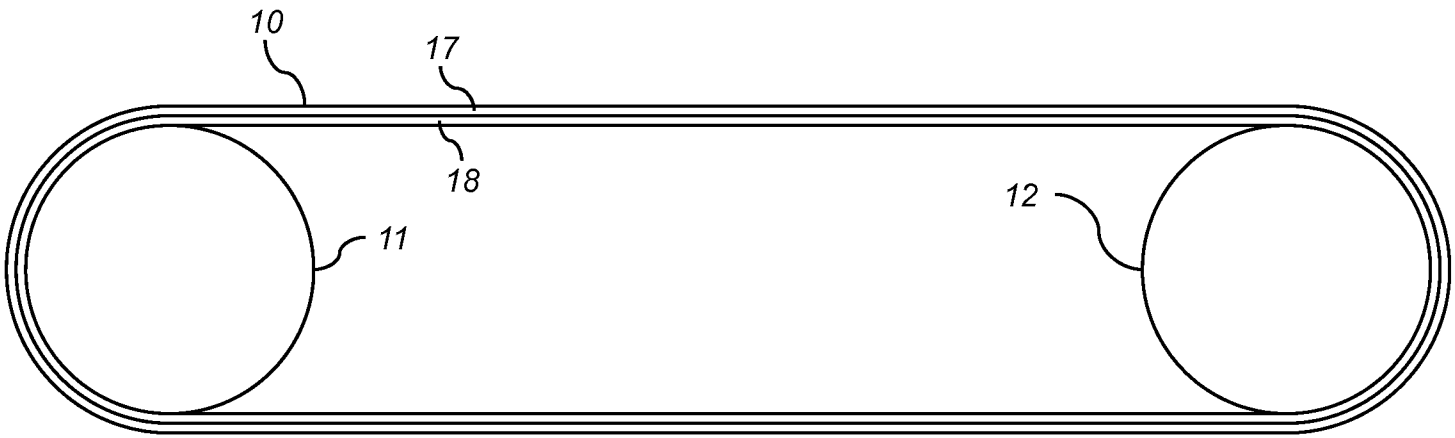
FIG. 2 is a side view of a transport belt having an outer non-conductive layer and an inner conductive layer.

With reference to FIG. 2, in some embodiments the transport belt 10 includes a plurality of layers. An outer layer 17 is electrically non-conducting so that it can hold a charge. In some embodiments, the outer layer 17 is a polar polymeric material such as PET. An inner layer 18 can be electrically conductive for providing an equipotential plane (e.g., a ground plane) to establish a more uniform electric field across the receiver medium between the transport belt 10 and the corona charging units 80 (FIG. 1B). In the embodiment shown in FIG. 2, the conductive inner layer 18 is in contact with rollers 11 and 12. In such cases, rollers 11 and 12 can be insulating, or can have an insulating surface. In other embodiments (not shown) a conductive inner layer can be sandwiched between two insulating layers. An electrically conductive contact ("grounding contact") can be made with the equipotential plane of the belt to remove or add charge as needed in a controlled fashion, thereby maintaining the equipotential plane at the desired potential, either by contact with conductive roller surfaces, or, for example, by contact with a conductive brush, such as one made of metal wires, carbon fibers, or other suitable materials, or by means of an electrical contact which provide a low electrical resistance connection without significantly abrading the belt surface.

Returning to a discussion of FIG. 1B, a charging subsystem 50 (which is shown as a corona charging unit 80) is configured to provide an initial electrostatic holding force between the transport belt 10 and receiver medium sheets 21*a*, 21*b*, 21*c*, 21*d*. In various embodiments, the charging subsystem 50 can charge the outer layer of transport belt 10 or it can charge the receiver medium sheets 21*a*, 21*b*, 21*c*, 21*d* to provide the electrostatic holding force. In some configurations, charges of opposite polarities are provided on both the outer surface of transport belt 10 and the receiver medium sheets 21*a*, 21*b*, 21*c*, 21*d*. In other configurations, charge is provided on the receiver medium sheets 21*a*, 21*b*, 21*c*, 21*d* and an opposite polarity charge is induced on the outer surface of transport belt 10. In the illustrated embodiment, the charging subsystem 50 is a corona charging unit 80 that is spaced apart from the outer surface of transport belt 10 and impinges charged particles (e.g., ions or electrons) onto the outer surface of transport belt 10 or onto an upper surface of a receiver medium sheet 21*a*, 21*b*, 21*c*, 21*d* being transported by transport belt 10. Optionally, the charging subsystem 50 can be air purged (e.g., by using a blower 84 as shown in FIG. 1A).

The receiver medium sheets 21*a*, 21*b*, 21*c*, 21*d* (e.g., paper) typically have high resistivity (such as around $1\times10^{13}$ Ω-cm) when it is dry, so that it can hold a charge. However, its resistivity can drop by several orders of magnitude when it is moistened, which can cause charge to dissipate.

A first inking subsystem 31 is positioned downstream of charging subsystem 50 and deposits a pattern of ink on receiver medium sheet 21*a* as it moves past the first inking subsystem 31. If printer 100 is an inkjet printer, first inking subsystem 31 can include a drop-on-demand or continuous inkjet printhead that ejects drops of ink 32. Initially, the deposited ink provides a wet ink pattern 41 on the surface of the receiver medium sheet 21*a*. Subsequently, a portion of the carrier fluid in the ink will typically be absorbed into the body of the receiver medium sheet 21*a* or into surface coatings on the receiver medium sheet 21*a*.

The printer 100 optionally includes one or more dryers (i.e., first dryer 61 and second dryer 62) for at least partially drying the deposited ink on the receiver medium. Receiver medium sheet 21*b* represents a piece of receiver medium that has advanced along the transport path 15 to a position in proximity to a first dryer 61 that is positioned downstream of first inking subsystem 31. First dryer 61 is represented graphically in FIG. 1B as a hot air blower, but it could alternatively be a radiant heater or any other type of dryer system known in the art. First dryer 61 assists in the evaporation of volatile components of the ink that was deposited on the receiver medium sheet 21*b* by first inking subsystem 31 in order to help dry the inked receiver medium sheet 21*b*. As a result of some of the carrier fluid being absorbed into receiver medium sheet 21*b* and some of the volatile components (e.g., water in the carrier fluid) being evaporated, deposited ink pattern 42 becomes substantially immobilized. This helps ensure that the inks (typically of different colors) that are deposited by the first inking subsystem 31 and the second inking subsystem 33 do not bleed into each other.

Charge on the receiver medium sheet 21*b* can be dissipated as the receiver medium sheet 21*b* becomes moistened by the ink and as volatile components of the ink evaporate. For example, evaporated water molecules can ionize and carry off charge as they leave the receiver medium sheet 21*b*, being driven away by the net electric field between the charged surface of receiver medium sheet 21*b* and the neutral free space above it. As the first dryer 61 drives faster evaporation (e.g. by elevated temperature), the charge on the receiver medium sheet 21*b* can become progressively dissipated in this region, thereby weakening the electrostatic holding force.

According to embodiments of the invention a first recharging subsystem 51 is positioned downstream of the first inking subsystem 31. For embodiments including first dryer 61, the first recharging subsystem 51 is preferably positioned downstream of first dryer 61. First recharging subsystem 51, which is shown as a corona charging unit 80 in FIG. 1B, is configured to restore at least some charge dissipated while the receiver medium sheet 21*b* is transported between the charging subsystem 50 and the first recharging subsystem 51, thereby restoring the electrostatic holding force between transport belt 10 and receiver medium sheet 21*b* to a level that provides reliable transport of the receiver medium sheet 21*b*. For the case where the first recharging subsystem 51 is a corona charging unit 80, it is spaced apart from the outer surface of transport belt 10 and impinges charged particles onto the an upper surface of the receiver medium sheet 21*b* being transported by transport belt 10. Optionally, first recharging subsystem 51 can be air purged (e.g., by using a blower 84 as shown in FIG. 1A).

A control system 90 is adapted to provide control over the various functions of printer 100, including controlling the first inking subsystem 31 and the second inking subsystem 33 to deposit patterns of ink on the receiver medium to form an image. Control system 90 can include a microprocessor incorporating suitable look-up tables and control software executable by control system 90. It can also include a field-programmable gate array, programmable logic device, microcontroller, or other digital control elements. It can include memory for storing control software and data.

One or more charge sensing devices 71, 72 are preferably positioned downstream of the first inking subsystem 31 and are used to sense a level of charge on the surface of receiver medium sheet 21*b*, or on the surface of transport belt 10. Charge sensing devices 71, 72 can be solid state electrometers or ammeters, for example, that provide a signal to control system 90. In the illustrated configuration, the first dryer 61 is positioned between first inking subsystem 31 and charge sensing devices 71, 72. Control system 90 can be adapted to control the first recharging subsystem 51 responsive to a sensed level of charge on the receiver medium sheet 21*b* as characterized by one or both of the charge sensing devices 71, 72. In some embodiments, the control system 90 adjusts a voltage on conductive grid 83 (FIG. 1A) of the corona charging unit 80 of the first recharging subsystem 51 to control a rate of impinging charge on receiver medium sheet 21*b*, as described in further detail below.

Charge sensing device 71 is positioned upstream of first recharging subsystem 51. In some embodiments, the control system 90 determines an amount of charge to be provided by first recharging subsystem 51 responsive to a difference between a level of charge sensed by charge sensing device 71 on receiver medium sheet 21*b* and an aim level of charge that is known to provide sufficient electrostatic holding force. The control system 90 then controls first recharging subsystem 51 to provide all or part of the difference in charge to the receiver medium sheet 21*b*. This approach provides a feed-forward mechanism to control the charge level provided by the first recharging subsystem 51.

Charge sensing device 72 is positioned downstream of first recharging subsystem 51. In some embodiments, the charge sensing device 72 is used in conjunction with control system 90 to determine a charge difference between the level of charge sensed by charge sensing device 72 and an aim level of charge that is known to provide sufficient electrostatic holding force for receiver medium sheet 21*b*. The control system 90 determines an amount of charge to be provided by first recharging subsystem 51 to a subsequent sheet of receiver media (e.g., receiver medium sheet 21*a*) responsive to the determined charge difference in order to provide all or part of the difference in charge to subsequent receiver medium sheet 21*a*. This approach provides a feedback mechanism to control the charge level provided by the first recharging subsystem 51. Various embodiments of the invention can include either or both of the charge sensing device 71 and charge sensing device 72.

Second inking subsystem 33, located downstream of the first recharging subsystem 51, is controlled by control system 90 to deposit a second pattern of a second ink on receiver medium sheet 21*c* as receiver medium sheet 21*c* moves past it. If printer 100 is an inkjet printer, second inking subsystem 33 can include a drop-on-demand inkjet printhead or a continuous inkjet printhead that ejects drops of ink 34. Initially, the deposited ink provides a wet ink pattern 44 on the surface of the receiver medium sheet 21*c*. For clarity, the wet ink pattern 44 is shown adjacent to an ink pattern 43 that was deposited by first inking subsystem 31. However, in practice, the wet ink pattern 44 will typically overlap the ink pattern 43. Even though the wet ink pattern 44 is touching the ink pattern 43, the wet ink pattern 44 and the ink pattern 43 do not bleed into each other because ink pattern 43 is substantially immobilized due to absorption and evaporation of portions of carrier fluid. Subsequently, a portion of the carrier fluid in the wet ink pattern 44 will typically be absorbed into the body of the receiver medium sheet 21*c* or into surface coatings on the receiver medium sheet 21*c*.

Receiver medium sheet 21*d* represents a sheet of receiver medium that has advanced along transport path 15 to a position close to a second dryer 62 positioned downstream of second inking subsystem 33. The second dryer 62 is represented graphically in FIG. 1B as a hot air blower, but it could alternatively be a radiant heater or any other type of dryer system known in the art. The second dryer 62 assists in the evaporation of volatile components of ink that was deposited on receiver medium sheet 21*d* by the first inking subsystem 31 and the second inking subsystem 33 in order to help dry the inked receiver medium sheet 21*d*. As a result of some of the carrier fluid being absorbed into receiver medium sheet 21*d* and some of the volatile components (e.g., water in the carrier fluid) being evaporated, ink pattern 45 (deposited by first inking subsystem 31) and ink pattern 46 (deposited by second inking subsystem 33) become substantially immobilized. This helps ensure that the inks (typically of different colors) that are deposited by the first inking subsystem 31, the second inking subsystem 33 and any subsequent inking subsystems do not bleed into each other. (Although only two inking subsystems are shown in FIG. 1B, inkjet printers typically include at least four inking subsystems for depositing cyan, magenta, yellow and black ink to form a full color image.)

Charge on receiver medium sheet 21*d* can be dissipated as receiver medium sheet 21*d* becomes moistened by ink and as volatile components of ink evaporate, as described above relative to receiver medium sheet 21*b*. According to some embodiments of the invention a second recharging subsystem 52 is positioned downstream of second inking subsystem 33 and the second dryer 62. Second recharging subsystem 52, which is shown as a corona charging unit 80 in FIG. 1B, is configured to restore at least some charge dissipated while the receiver medium sheet 21*d* is transported between the first recharging subsystem 51 and the second recharging subsystem 52, thereby restoring the electrostatic holding force between transport belt 10 and receiver medium sheet 21*d* to a level that provides reliable transport of the receiver medium sheet 21*d*. For the case where the second recharging subsystem 52 is a corona charging unit 80, it is spaced apart from the outer surface of transport belt 10 and impinges charged particles onto the upper surface of the receiver medium sheet 21*d* being transported by transport belt 10. Optionally, second recharging subsystem 52 can be air purged (e.g., by using a blower 84 as shown in FIG. 1A).

One or more charge sensing devices 73, 74 can be positioned downstream of the second inking subsystem 33 and upstream or downstream, respectively, of the second recharging subsystem 52. The charge sensing devices 73, 74 operate in conjunction with control system 90 for controlling the second recharging subsystem 52 responsive to a sensed level of charge on the receiver medium sheet 21*d* in a similar manner to the charge sensing devices 71, 72 described above relative to the first recharging subsystem 51.

Figure 3:
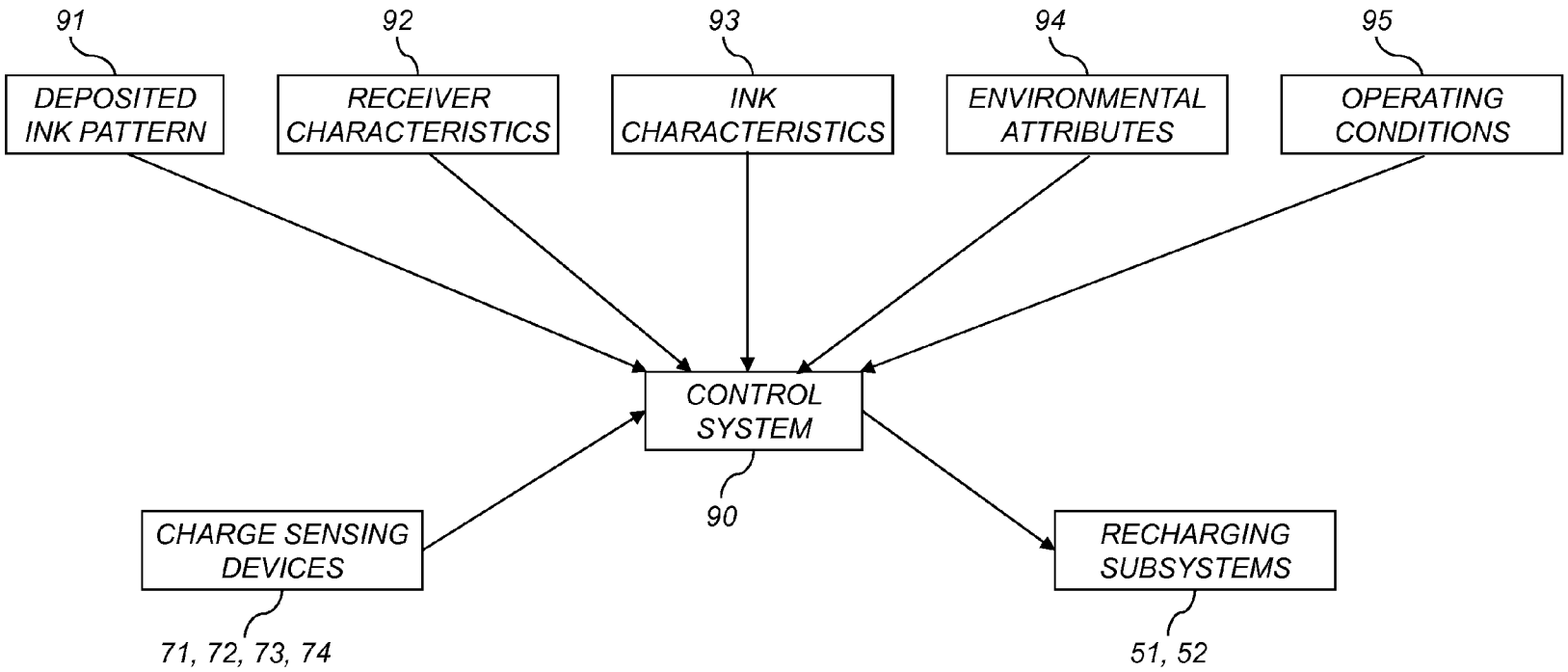
FIG. 3 indicates various inputs that can be used by the control system of the printer for controlling the recharging subsystem.

As described above control of first recharging subsystem 51 and second recharging subsystems 52 can be performed by control system 90 in response to sensed level of charge on the receiver medium. In some embodiments, other control factors can be used by control system 90 for determining how much charge should be directed by first recharging subsystem 51 and second recharging subsystems 52 toward the receiver medium sheets 21*b*, 21*d*. Examples of other control factors (in addition to charge information from charge sensing devices 71, 72, 73, 74) are shown schematically in FIG. 3 as information regarding deposited ink pattern 91, receiver characteristics 92, ink characteristics 93, environmental attributes 94, and operating conditions 95.

With regard to information on deposited ink pattern 91, in some embodiments, the control of one or both of the first recharging subsystem 51 and the second recharging subsystems 52 can be responsive to the amount of ink deposited on the receiver medium by the previous inking subsystems, or by the cumulative amount of ink that has been deposited. The more ink that has been deposited, the greater amount of charge that will be required for restoring the electrostatic holding force. In some embodiments, the control of one or both of the first recharging subsystem 51 and the second recharging subsystems 52 can be responsive to the spatial ink distribution deposited on the receiver medium. In this case, more charge can be applied to regions of the receiver medium that have been more heavily inked.

With regard to receiver characteristics 92, in some embodiments, the control of one or both of the first recharging subsystem 51 and the second recharging subsystems 52 can be responsive to characteristics of the receiver medium. Examples of receiver characteristics 92 that can influence the amount of charge that is required for restoring the electrostatic holding force include material type, material thickness, porosity, roughness, capacitance, resistivity, and dielectric strength. In some embodiments, the effect of the various receiver characteristics 92 on the amount of charge that is required can be characterized ahead of time, either in the form of a parametric model, or as a measured characteristic for a set of available receiver medium types.

With regard to ink characteristics 93, in some embodiments, the control of one or both of the first recharging subsystem 51 and the second recharging subsystems 52 can be responsive to characteristics of the ink. Examples of particular ink characteristics 93 that can influence the amount of charge that is required for restoring the electrostatic holding force include electrical conductivity, carrier fluid volatility and type, and concentration of components such as surfactants and carrier fluid. In some embodiments, the effect of the various ink characteristics 93 on the amount of charge that is required can be characterized ahead of time, either in the form of a parametric model, or as a measured characteristic for a set of available ink types.

With regard to environmental attributes 94, in some embodiments, the control of one or both of the first recharging subsystem 51 and the second recharging subsystems 52 can be responsive to attributes of the environment such as temperature and humidity, which can be sensed using environmental sensors. In some embodiments, the effect of the environmental attributes 94 on the amount of charge that is required can be characterized ahead of time, either in the form of a parametric model, or as a measured characteristic for a set of typical environmental conditions.

With regard to operating conditions 95, in some embodiments, the control of one or both of the first recharging subsystem 51 and the second recharging subsystems 52 can be responsive to operating conditions of the operation of the printer 100 (FIG. 1B). Examples of operating conditions 95 can include the speed of the transport belt 10, the number and position of inking subsystems 31, 33 and others, the print mode (e.g., color vs. grayscale, and draft vs. normal) and the power level of the dryers 61, 62. In some embodiments, the effect of the operating conditions 95 on the amount of charge that is required can be characterized ahead of time, either in the form of a parametric model, or as a measured characteristic for a set of typical environmental conditions.

Returning to a discussion of FIG. 1B, an added benefit of using corona charging units 80 for one or both of the first recharging subsystem 51 and the second recharging subsystem 52, is that the evaporation rate of water can be enhanced with air ions from a corona discharge. (See Barthakur et al., "Evaporation rate enhancement of water with air ions from a corona discharge," International Journal of Biometeorology, Vol. 31, pp. 29-33, 1995.) Thus, drying of the receiver medium sheets 21*a*, 21*b*, 21*c*, 21*d* can be enhanced by the corona discharge used to increase the electrostatic holding force.

In some embodiments some or all of the charging subsystem 50, the first recharging subsystem 51 and the second recharging subsystem 52 are self-limiting chargers adapted to provide an aim level of charge on the receiver medium, where the aim level of charge corresponds to a receiver surface voltage that approaches the grid voltage of the corona charging unit 80. A self-limiting charger ideally charges the receiver surface to a voltage level corresponding to 100% of the control grid voltage of the corona charging unit 80. More typically the receiver surface does not receive enough charge to reach 100% of the grid voltage. As the receiver surface receives charge, its surface voltage increases and begins to approach the grid voltage. As a result, the electric field between the receiver medium and the conductive grid 83 decreases and provides less of a driving force to move ions to the receiver medium. More ions strike the body 81 of the corona charging unit 80, so that the charging rate of the receiver medium decreases. The surface voltage of the receiver medium approaches the grid voltage and reaches a value that is determined by the charging efficiency. Some factors affecting the charging efficiency include speed of the transport belt 10 and width of the corona charging unit 80 (related to residence time of the receiver medium sheet 21*a*, 21*b*, 21*c*, 21*d* under the corona charging unit 80); design of the conductive grid 83 (including grid conductor spacing periodicity and total number of conductors in conductive grid 83); and characteristics of the receiver medium including resistivity, dielectric constant and thickness or capacitance.

Figure 4:
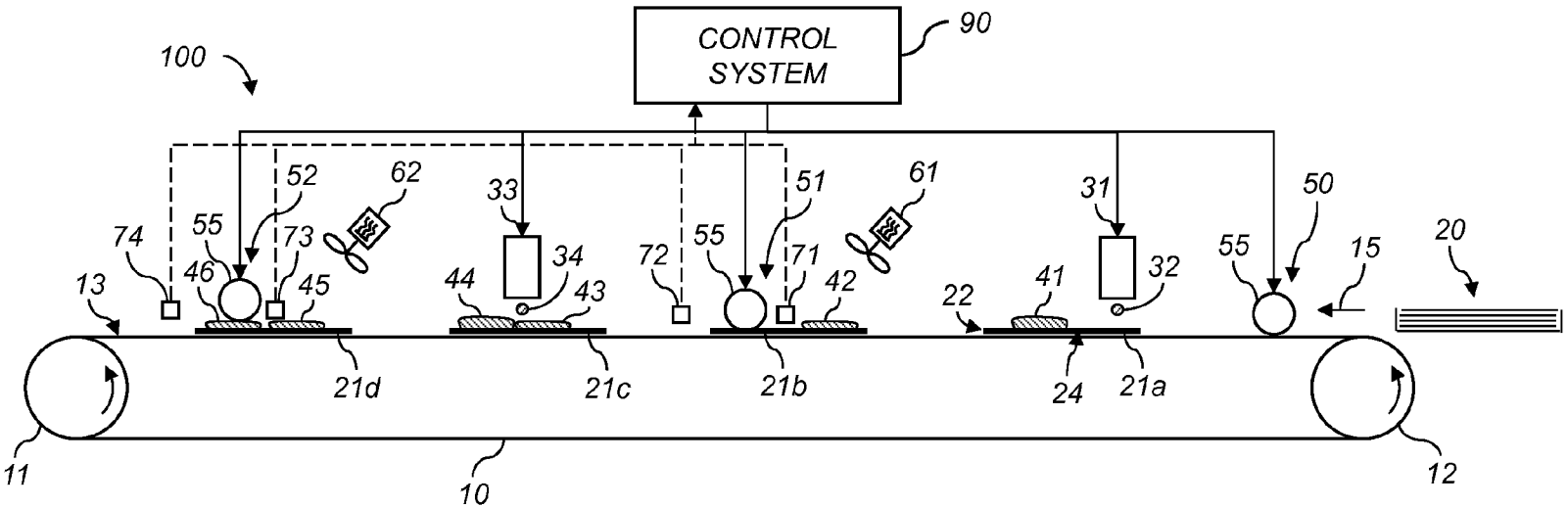
FIG. 4 is similar to FIG. 1B, except that the charging and recharging subsystems use contact charging elements rather than corona charging units.

In the embodiments described above, corona charging units 80 were used in the charging subsystem 50, the first recharging subsystem 51 and the second recharging subsystem 52. FIG. 4 shows a side view of a printer 100 according to an alternate embodiment where the charging subsystem 50, the first recharging subsystem 51 and the second recharging subsystem 52 include a charged element 55 (such as a roller connected to high voltage) that contacts the outer surface of transport belt 10 or the receiver medium sheets 21*a*, 21*b*, 21*c*, 21*d* being transported by transport belt 10, thereby transferring charge to the transport belt 10 or to the receiver medium sheets 21*a*, 21*b*, 21*c*, 21*d*. Current flow to charged element 55 is controlled by control system 90 in order to control the amount of transferred charge. In various embodiments, control of current flow by the control system 90 can be responsive to signals from charge sensing devices 71. 72, 73, 74, as well as other control factors such as the operating voltage of the charged element 55 and the control factors that were discussed relative to FIG. 3.

In some embodiments, some or all of the charging subsystem 50, the first recharging subsystem 51 and the second recharging subsystem 52 are adapted to provide a non-uniform charge on the receiver medium (e.g., receiver medium sheet 21*a*). FIGS. 5A-5G illustrate several examples of non-uniform charge distributions that can be applied to receiver medium sheets 21. A characteristic of a non-uniform charge distribution is that the electrostatic holding force is higher in a sub-region of the receiver medium sheet 21 than it is for the rest of the receiver medium sheet 21. As a result, the sub-region of the receiver medium sheet 21 is held to the transport belt 10 more tightly than the rest of the receiver medium sheet 21. This allows the receiver medium sheet 21 to expand and contract without buckling or wrinkling, while it remains held tightly to transport belt 10 (FIG. 1B).

In an inkjet printer, the carrier fluid that is absorbed in the receiver medium sheet can cause it to expand. Also, when the receiver medium sheet is exposed to the dryers 61, 62 (FIG. 1B), a portion of the carrier fluid is removed and receiver medium sheet can contract. If the entire receiver medium sheet is held tightly to the transport belt 10, the receiver medium sheet can buckle or wrinkle during such dimensional changes. If the receiver medium sheet is held at a sub-region, such as along a leading edge 22 or in a central portion 24 (FIG. 1B) of the receiver medium sheet, expansion or contraction of receiver medium sheet can occur without resulting in forces that tend to buckle or wrinkle the receiver medium sheet. In such embodiments, in order to restore such a position-dependent charge after ink is deposited on the receiver medium sheet, charge sensing devices 71, 72, 73 or 74 are used to sense a position-dependent level of charge on the receiver medium sheet, and the control system 90 is adapted to control the first recharging subsystem 51 and the second recharging subsystem 52 to provide a position-dependent amount of charge that is responsive to the sensed position-dependent level of charge on the receiver medium sheet.

Figure 6A:
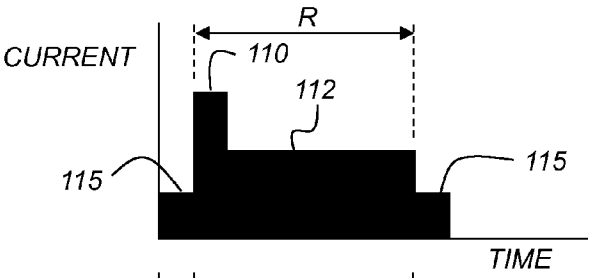
FIGS. 6A-6D show time dependant charger/recharger current levels for providing a position-dependent non-uniform charge on sheets of receiver medium.

FIG. 5A shows an example of a non-uniform charge distribution applied to a receiver medium sheet 21 where a higher charge region 210 is provided in a sub-region of the receiver medium sheet 21 along the leading edge, and a lower charge region 220 is provided over the rest of the receiver medium sheet 21. FIG. 6A shows a plot of charger current vs. time for charging subsystem 50 that can be used to form the charge distribution of FIG. 5A. In this example, the charger current is varied as a function of time as the receiver medium sheet 21 is moved past the charging subsystem 50 by the transport belt 10 (FIG. 1B). The range of times when the receiver medium sheet is passing the charging subsystem 50 is indicated by the range R. A relatively low level of charger current 115 is optionally applied by the charging subsystem 50 to the transport belt 10 at times between receiver medium sheets. As the leading edge 22 (FIG. 5A) of the receiver medium sheet 21 passes the charging subsystem 50, a relatively high level of charger current 110 is provided by charging subsystem 50 to a sub-region of the receiver media sheet near the leading edge 22 (i.e., the higher charge region 210 of FIG. 5A) in order to provide a higher level of electrostatic holding force in that sub-region. After the leading edge 22 passes the charging subsystem 50, a lower level of charger current 112 is provided by charging subsystem 50 to the rest of the receiver medium sheet 21. The level of charger current 112 is lower than the level of charger current 110, so that the lower charge region 220 (FIG. 5A) of the receiver medium sheet 21 has a lower level of electrostatic force so that it can move more freely relative to transport belt 10 (e.g., due to expansion or contraction).

Figure 6B:
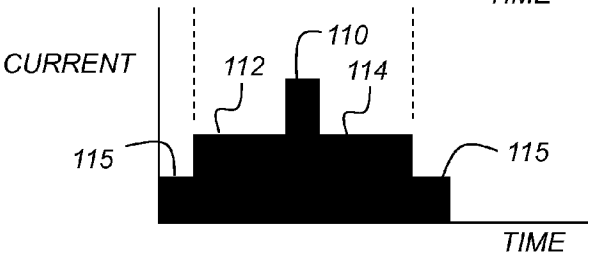

FIG. 5B is similar to FIG. 5A except that the higher charge region 210 is in a central portion 24 of the receiver medium sheet 21. FIG. 6B shows a corresponding plot of charger current vs. time for charging subsystem 50 that can be used to form the charge distribution of FIG. 5B. In this case, as the leading edge 22 of the receiver medium sheet passes charging subsystem 50, a lower level of charger current 112 is provided by charging subsystem 50 to provide a lower level of electrostatic holding force in the lower charge region 220 of FIG. 5B. As the central portion 24 of the receiver medium sheet passes charging subsystem 50, a relatively higher level of charger current 110 is provided by charging subsystem 50 in order to provide a higher level of electrostatic holding force in that sub-region of the receiver medium sheet (i.e., the higher charge region 210 shown in FIG. 5B). After the central portion 24 passes charging subsystem 50, a lower level of charger current 114 is provided by charging subsystem 50 to the rest of the receiver medium sheet 21 in order to provide a lower level of electrostatic holding force in lower charge region 225 shown in FIG. 5B). In some embodiments, the charger current 114 is optionally equal to charger current 112 so that the lower charge regions 220 and 225 have the same charge level.

Figure 6C:
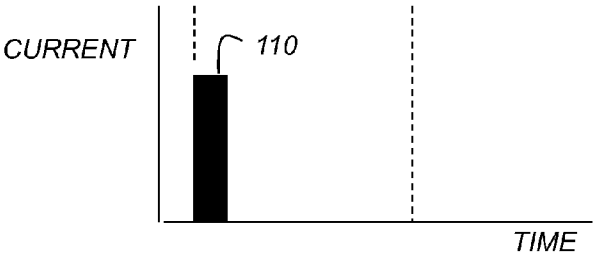

FIG. 5C is similar to FIG. 5A except that no charge is applied outside of the higher charge region 210 along the leading edge 22 of the receiver medium sheet 21, thereby providing an uncharged region 200. FIG. 6C shows a corresponding plot of charger current vs. time for charging subsystem 50 that can be used to form the charge distribution of FIG. 5C. In this case, no electrostatic holding force is provided in the uncharged region 200 corresponding to the portion of the receiver medium sheet 21 outside of the leading edge sub-region.

The examples shown in FIGS. 5A-5C describe non-uniform charge distributions that vary along an in-track direction of the receiver medium sheet 21, and are substantially constant across a cross-track direction. However, this is not required. In other embodiments, the charge distribution may be non-uniform in the cross-track direction. For example, a higher level of charge can be provided in a higher charge region 210 in a central portion 24 of the receiver medium sheet 21 corresponding to a central stripe extending from the leading edge 22 to the trailing edge 23 as shown in FIG. 5D. Lower charge regions 220 and 225 are provided to either side of the higher charge region 210. Similarly, a higher level of charge can be provided in a higher charge region 210 extending along a side edge of the receiver medium sheet 21 as shown in FIG. 5E.

In other embodiments, the charge distribution may be non-uniform in both the cross-track and the in-track directions. FIG. 5F shows an example where the higher charge region 210 extends along both the leading edge 22 (as in FIG. 5A) and along the central stripe from the leading edge 22 to the trailing edge 23 (as in FIG. 5D). FIG. 5G shows another example where the higher charge region 210 is provided in a sub-region corresponding to a central portion of the leading edge region.

In order to provide non-uniform charge distributions that vary in the cross-track direction, the charging subsystem 50 (as well as the first and second recharging subsystems 51 and 52) must be controllable to provide different charge levels at different cross-track positions. In some embodiments this can be done by using a plurality of independently controllable corona charging units 80 that span different cross-track portions of the receiver medium sheet 21. The charge provided by each of the corona charging units 80 can be controlled by various means such as adjusting the charger current, or the grid potential of the conductive grid 83 (FIG. 1A). Alternately, a single corona charging unit 80 can be used where the conductive grid 83 is segmented into different cross-track segments that can be independently controlled to provide different grid potentials, or have different physical geometries (e.g., grid spacings).

Figure 6D:
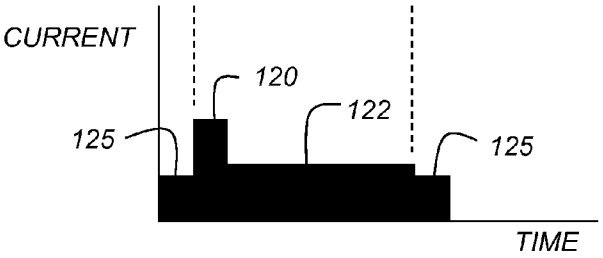

FIGS. 6A-6C, which were discussed earlier, show charger currents for the charging subsystem 50 that can be used to form initial position-dependent charge patterns on the receiver medium sheet 21. In a similar fashion, position-dependent charge patterns can also be provided by the first recharging subsystem 51 and the second recharging subsystem 52. FIG. 6D is similar to FIG. 6A, but shows a plot of charger current vs. time for first recharging subsystem 51. In this case, the control system 90 controls first recharging subsystem 51 to provide a position-dependent amount of charge that is intended to restore at least some of the position-dependent charge that has been dissipated while the receiver medium sheet 21 is transported between the charging subsystem 50 and first recharging subsystem 51. A relatively low level of recharger current 125 is optionally applied by the first recharging subsystem 51 to the transport belt 10 at times between receiver medium sheets 21. (The level of recharger current 125 is typically less than or equal to the level charger current 115 in FIG. 6A.) As the leading edge 22 (FIG. 5A) of the receiver medium sheet 21 passes the first recharging subsystem 51, a recharger current 120 is provided by first recharging subsystem 51 to the leading edge sub-region of the receiver medium sheet 21 (i.e., the higher charge region 210 in FIG. 5A) in order to restore at least a portion of the dissipated charge. After the leading edge sub-region passes the first recharging subsystem 51, a different recharger current 122 is provided by the first recharging subsystem 51 to the rest of the receiver medium sheet 21 corresponding to the lower charge region 220 (FIG. 5A). As discussed earlier, the levels of the recharger currents 120, 122 are preferably determined responsive to signals from charge sensing devices 71, 72, 73, 74 which are used to determine a difference between an aim charge level and an actual charge level. Generally, the recharger currents 120, 122 will be lower than the corresponding charger currents 110, 112 since only a portion of the charge will have been dissipated.

U.S. Pat. No. 8,408,539 to Moore, entitled "Sheet transport and hold down apparatus," discloses an inkjet printer having a transport belt that primarily provides holding force for sheets of receiver medium using vacuum. At the two opposing side edges of the sheet, an electrostatic holding force is applied to further aid in holding the sheet in a flat position. Although the printer described by Moore has a charging subsystem providing a non-uniform charge on a sheet of receiver medium, the function is not to hold receiver medium more tightly at the side edges (where the electrostatic holding force is applied) than it is in the rest of the sheet where it is held by vacuum. Rather, the intent is to tightly hold the receiver medium across the entire width, including along the edges where the vacuum system was found to not provide a tight holding force. Since the receiver medium is held tightly across the entire width, it does not provide the advantage of enabling the receiver medium to expand and contract freely to avoid wrinkling of the receiver medium.

The invention has been described in detail with particular reference to certain preferred embodiments thereof, but it will be understood that variations, combinations, and modifications can be effected by a person of ordinary skill in the art within the spirit and scope of the invention.

PARTS LIST

10 transport belt
11 roller
12 roller
13 upper belt portion
15 transport path
17 outer layer
18 inner layer
20 receiver medium stack
21 receiver medium sheet
21*a* receiver medium sheet
21*b* receiver medium sheet
21*c* receiver medium sheet
21*d* receiver medium sheet
22 leading edge
23 trailing edge
24 central portion
31 inking subsystem
32 drops of ink
33 inking subsystem
34 drops of ink
41 wet ink pattern
42 ink pattern
43 ink pattern
44 wet ink pattern
45 ink pattern
46 ink pattern
50 charging subsystem
51 first recharging subsystem
52 second recharging subsystem
55 charged element
61 dryer
62 dryer
71 charge sensing device
72 charge sensing device
73 charge sensing device
74 charge sensing device
80 corona charging unit
81 body
82 wire
83 conductive grid
84 blower
90 control system
91 deposited ink pattern
92 receiver characteristics
93 ink characteristics
94 environmental attributes
95 operating conditions
100 printer
110 charger current
112 charger current
114 charger current
115 charger current
120 recharger current
122 recharger current
125 recharger current
200 uncharged region
210 higher charge region
220 lower charge region
225 lower charge region

The invention claimed is:

1. A printer comprising:

a transport belt having an electrically non-conducting surface adapted to transport a receiver medium along a transport path from an upstream position to a downstream position;

a charging subsystem configured to add charge to the transport belt or the receiver medium, thereby providing an electrostatic holding force between the transport belt and the receiver medium;

an inking subsystem positioned downstream of the charging subsystem that deposits a pattern of ink on the receiver medium;

a dryer positioned downstream of the inking subsystem adapted to dry the inked receiver medium; and a recharging subsystem positioned downstream of the dryer configured to restore at least some charge dissipated while the receiver medium is transported between the charging subsystem and the recharging subsystem.

2. The printer of claim 1 further including:

a charge sensing device for sensing a level of charge on the receiver medium; and a control system adapted to control the recharging subsystem responsive to a sensed level of charge on the receiver medium.

3. The printer of claim 2 wherein the charge sensing device is positioned upstream of the recharging subsystem, and wherein the control system determines an amount of charge to be provided by the recharging subsystem responsive to a difference between the sensed level of charge and an aim level of charge.

4. The printer of claim 2 wherein the charge sensing device is positioned downstream of the recharging subsystem, and wherein the control system determines a charge difference between the sensed level of charge and an aim level of charge for a first receiver medium, and wherein an amount of charge to be provided by the recharging subsystem for a subsequent receiver medium is controlled responsive to the determined charge difference.

5. The printer of claim 1 wherein the recharging subsystem is controlled responsive to the pattern ink deposited on the receiver medium by the inking subsystem.

6. The printer of claim 1 wherein the recharging subsystem is controlled responsive to one or more characteristics of the receiver medium.

7. The printer of claim 1 wherein the recharging subsystem is controlled responsive to one or more characteristics of the ink deposited by the inking subsystem.

8. The printer of claim 1 wherein the recharging subsystem is controlled responsive to one or more environmental attributes sensed using corresponding environmental sensors.

9. The printer of claim 1 wherein the recharging subsystem is controlled responsive to one or more printer operating conditions.

10. The printer of claim 1 wherein one or both of the charging subsystem and the recharging subsystem are spaced apart from the surface of the transport belt and impinge charged particles onto the surface of the transport belt or onto a surface of the receiver medium being transported by the transport belt.

11. The printer of claim 10 wherein one or both of the charging subsystem and the recharging subsystem include a conductive grid, and wherein a voltage on the conductive grid is controlled to control a rate of impinging charge.

12. The printer of claim 10 wherein one or both of the charging subsystem and the recharging subsystem are air-purged.

13. The printer of claim 1 wherein one or both of the charging subsystem and the recharging subsystem include a charged element that contacts the surface of the transport belt or contacts the receiver medium being transported by the transport belt and thereby transfers charge to the receiver medium or the transport belt.

14. The printer of claim 1 wherein one or both of the charging subsystem and the recharging subsystem provide a non-uniform charge on the receiver medium such that the electrostatic holding force is higher in a sub-region of the receiver medium than it is for other portions of the receiver medium such that the sub-region of the receiver medium is held to the transport belt more tightly than the other portions of the receiver medium, thereby enabling the receiver medium to expand as a result of ink being deposited by the inking subsystem.

15. The printer of claim 1 wherein one or both of the charging subsystem and the recharging subsystem are self-limiting chargers adapted to provide an aim level of charge on the receiver medium.

16. The printer of claim 1 wherein the printer further includes:

a second inking subsystem;

a second dryer; and a second recharging subsystem positioned downstream of the second dryer configured to restore at least some charge dissipated while the receiver medium is transported between the recharging subsystem and the second recharging subsystem.

17. The printer of claim 1 wherein the transport belt further includes a conductive layer.

18. The printer of claim 1 wherein the printer is an inkjet printer, and wherein the inking subsystem includes an inkjet printhead.

19. The printer of claim 1 wherein the ink includes a carrier fluid which is absorbed by the receiver medium, and wherein the dryer removes at least a portion of the carrier fluid from the inked receiver medium.

20. The printer of claim 1 wherein the receiver medium is a cut-sheet receiver medium.

* * * * *